US008281691B2

(12) United States Patent
Hickman

(10) Patent No.: US 8,281,691 B2
(45) Date of Patent: Oct. 9, 2012

(54) TONG ASSEMBLY

(76) Inventor: Don Darrell Hickman, Williston, ND (US)

( * ) Notice: Subject to any disclaimer, the term of this patent is extended or adjusted under 35 U.S.C. 154(b) by 340 days.

(21) Appl. No.: 12/772,815

(22) Filed: May 3, 2010

(65) Prior Publication Data

US 2010/0300251 A1 Dec. 2, 2010

Related U.S. Application Data

(60) Provisional application No. 61/175,029, filed on May 3, 2009.

(51) Int. Cl.
*B25B 13/50* (2006.01)

(52) U.S. Cl. ..... 81/57.15; 81/57.33

(58) Field of Classification Search ..... 81/57.11–57.35
See application file for complete search history.

(56) References Cited

U.S. PATENT DOCUMENTS

| | | | | | |
|---|---|---|---|---|---|
| D29,522 | S | | 10/1898 | Cummings | |
| D243,406 | S | | 2/1977 | Mooney et al. | |
| 4,215,602 | A | * | 8/1980 | Carstensen et al. | 81/57.18 |
| D258,828 | S | | 4/1981 | Zrobek | |
| 4,266,450 | A | * | 5/1981 | Farr et al. | 81/57.33 |
| 4,357,843 | A | * | 11/1982 | Peck et al. | 81/57.16 |
| 4,401,000 | A | | 8/1983 | Kinzbach | |
| RE31,699 | E | * | 10/1984 | Eckel | 73/862.25 |
| 4,485,697 | A | * | 12/1984 | Heilhecker et al. | 81/57.2 |
| 4,487,092 | A | * | 12/1984 | Neves | 81/57.18 |
| D285,109 | S | | 8/1986 | Jornhagen | |
| D337,336 | S | | 7/1993 | Losdahl | |
| D357,030 | S | | 4/1995 | McKenna | |
| D371,138 | S | | 6/1996 | Waskiewicz | |
| D372,254 | S | | 7/1996 | Hirayama et al. | |
| D379,999 | S | | 6/1997 | Benson | |
| 6,058,811 | A | | 5/2000 | Stuart | |
| D436,117 | S | | 1/2001 | Chuang | |
| D440,581 | S | | 4/2001 | Sherman, II et al. | |
| 6,212,763 | B1 | | 4/2001 | Newman | |
| D444,802 | S | | 7/2001 | Dyson et al. | |
| 6,327,938 | B1 | | 12/2001 | Pietras | |
| 6,758,095 | B2 | | 7/2004 | Newman | |
| 6,829,967 | B1 | | 12/2004 | Kemp | |
| 7,069,817 | B2 | | 7/2006 | Wesch, Jr. | |
| 7,519,508 | B2 | | 4/2009 | Newman | |
| 7,631,563 | B2 | | 12/2009 | Newman | |
| 7,992,274 | B2 | | 8/2011 | Hickman | |
| 2003/0177870 | A1 | * | 9/2003 | Neves et al. | 81/57.2 |
| 2007/0062339 | A1 | * | 3/2007 | Dagenais et al. | 81/57.18 |

OTHER PUBLICATIONS

BJ Hughes, Power Tong Transmission Assembly, 2 pages, Admitted Prior Art.

* cited by examiner

*Primary Examiner* — David B Thomas
(74) *Attorney, Agent, or Firm* — Merchant & Gould PC

(57) ABSTRACT

A tong assembly includes a case assembly having an enclosure defining an interior. A bearing assembly is disposed in the interior of the enclosure. The bearing assembly includes a first bearing member defining a first cavity and a second bearing member defining a first cavity. A tong head assembly is disposed in the interior of the enclosure of the case assembly. The tong head assembly includes a tong head engaged with an outer ring gear. The outer ring gear includes a first axial end portion, an oppositely disposed second axial end portion and a central portion. The first axial end portion is disposed in the first cavity of the first bearing member. The second axial end portion is disposed in the first cavity of the second bearing member.

20 Claims, 18 Drawing Sheets

TONG ASSEMBLY

CROSS REFERENCE TO RELATED APPLICATION

This application claims the benefit of U.S. Provisional Patent Application Ser. No. 61/175,029, filed May 3, 2009, which is hereby incorporated by reference in its entirety.

BACKGROUND

Power tongs are frequently used in the oil and gas industry for threadably connecting and disconnecting oil field tubulars such as those commonly referred to as casing, tubing and as "sucker" rods. Power tongs include a tong assembly and a transmission assembly. The transmission assembly typically includes a hydraulic motor and an operator valve. The tong assembly typically includes either a closed-head tong or an open-head tong having a jaw which engages the tubulars. When the jaw of the tong assembly is clamped onto the tubulars, the transmission assembly causes the tong assembly to rotate in either a clockwise or counterclockwise direction to either thread or unthread the tubular.

SUMMARY

An aspect of the present disclosure relates to a tong assembly. The tong assembly includes a case assembly having an enclosure defining an interior. A bearing assembly is disposed in the interior of the enclosure. The bearing assembly includes a first bearing member defining a first cavity and a second bearing member defining a first cavity. A tong head assembly is disposed in the interior of the enclosure of the case assembly. The tong head assembly includes a tong head engaged with an outer ring gear. The outer ring gear includes a first axial end portion, an oppositely disposed second axial end portion and a central portion. The central portion includes a plurality of gear teeth. The first axial end portion is disposed in the first cavity of the first bearing member. The second axial end portion is disposed in the first cavity of the second bearing member. In one aspect of the present disclosure, the first and second bearing members are made from a phenolic material.

Another aspect of the present disclosure relates to a tong assembly. The tong assembly includes a case assembly including an enclosure defining an interior. A bearing assembly is disposed in the interior of the enclosure. The bearing assembly includes a first bearing member defining a first cavity and a second cavity and a second bearing member defining a first cavity and a second cavity. A tong head assembly is disposed in the interior of the case assembly. The tong head assembly includes an outer ring gear. The outer ring gear includes a first axial end portion, an oppositely disposed second axial end portion and a central portion. The central portion includes a plurality of gear teeth. The first axial end portion is disposed in the first cavity of the first bearing member and a first portion of the central portion is disposed in the second cavity of the first bearing member. The second axial end portion is disposed in the first cavity of the second bearing member and a second portion of the central portion is disposed in the second cavity of the second bearing member.

Another aspect of the present disclosure relates to an outer ring gear assembly for a tong assembly. The outer ring gear assembly includes an outer ring gear and a bearing assembly. The outer ring gear includes a first axial end portion, an oppositely disposed second axial end portion and a central portion disposed between the first and second axial end portions. The central portion has an outer diameter that is greater than an outer diameter of the first axial end portion and an outer diameter of the second axial end portion. The central portion includes a plurality of external teeth. The bearing assembly includes a first bearing member and a second bearing member. The first bearing member has a first axial end and an oppositely disposed second axial end. The first bearing member defines a thru-bore that extends through the first and second axial ends. The first bearing member defines a first cavity disposed adjacent to the first axial end and a second cavity disposed adjacent to the second axial end. An inner diameter of the second cavity is greater than an inner diameter of the first cavity. The second bearing member includes a first axial end and an oppositely disposed second axial end. The second bearing member defines a thru-bore that extends through the first and second axial ends. The second bearing member defines a first cavity disposed adjacent to the first axial end and a second cavity disposed adjacent to the second axial end. An inner diameter of the second cavity is greater than an inner diameter of the first cavity. The first axial end portion of the outer ring gear is disposed in the first cavity of the first bearing member and a first portion of the central portion of the outer ring gear is disposed in the second cavity of the first bearing member. The second axial end portion of the outer ring gear is disposed in the first cavity of the second bearing member and a second portion of the central portion of the outer ring gear is disposed in the second cavity of the second bearing member.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
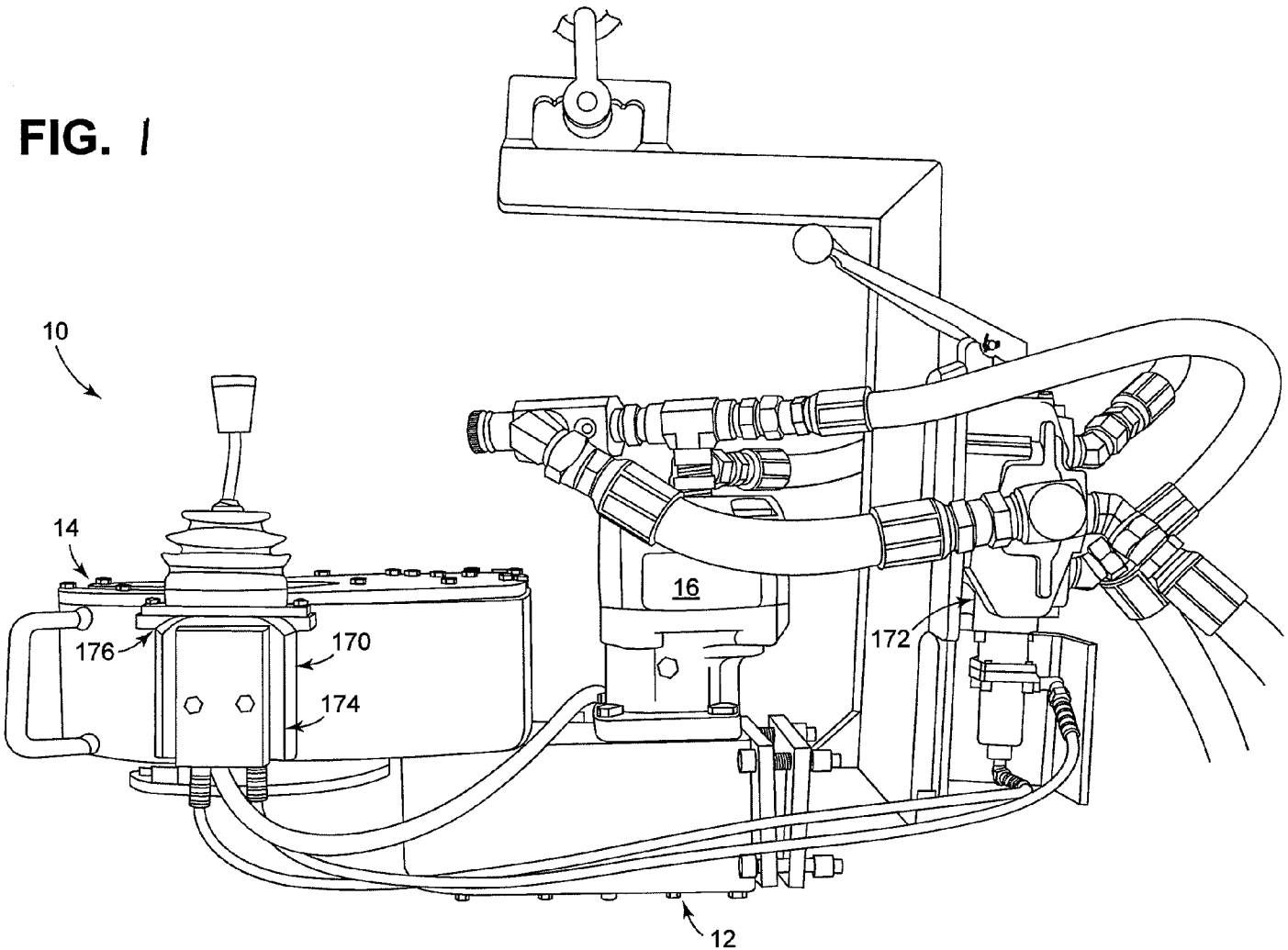
FIG. 1 is a side view of a tong assembly having exemplary features of aspects in accordance with the principles of the present disclosure.
Figure 2:
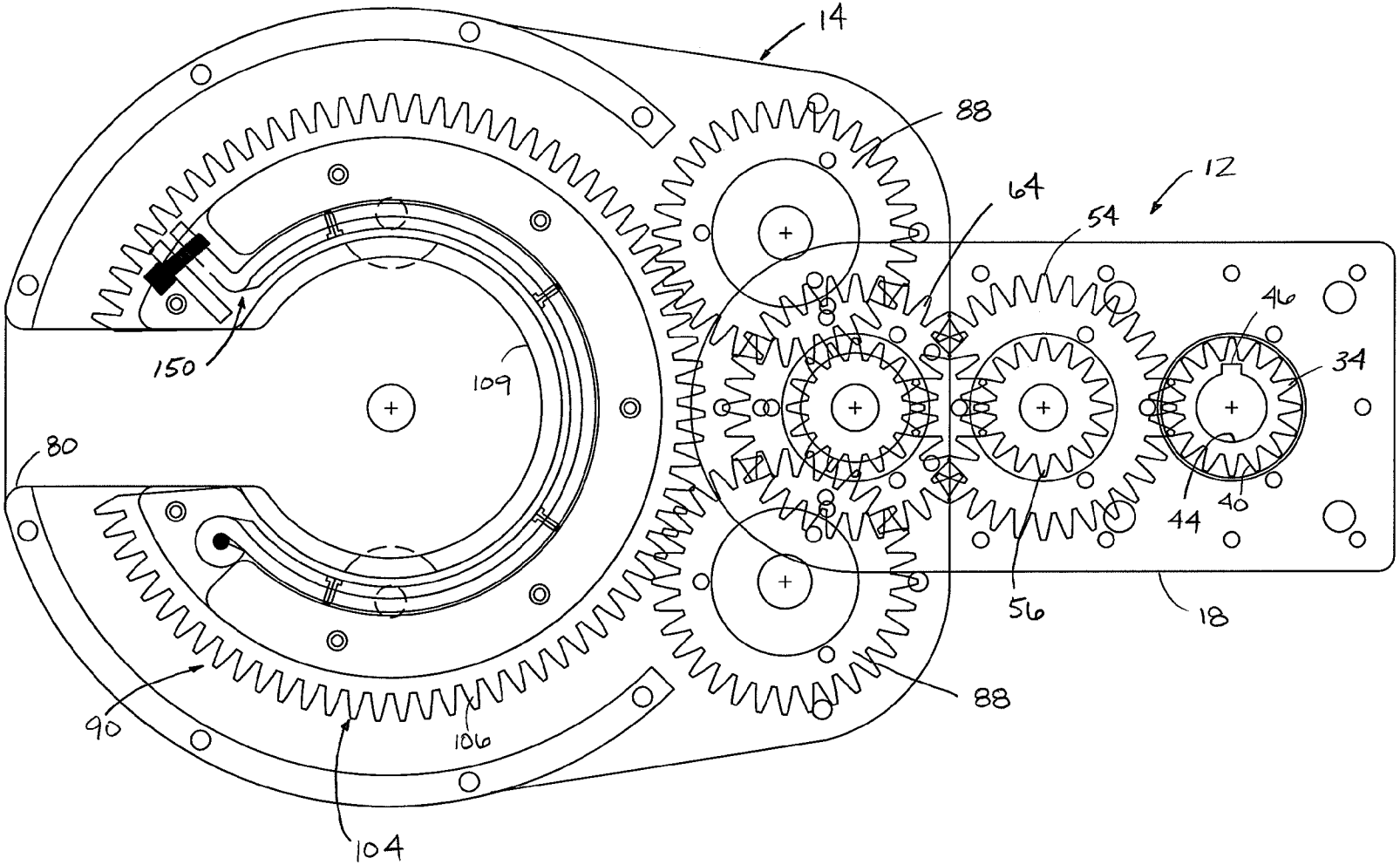
FIG. 2 is a bottom view of the tong assembly of FIG. 1.
Figure 3:
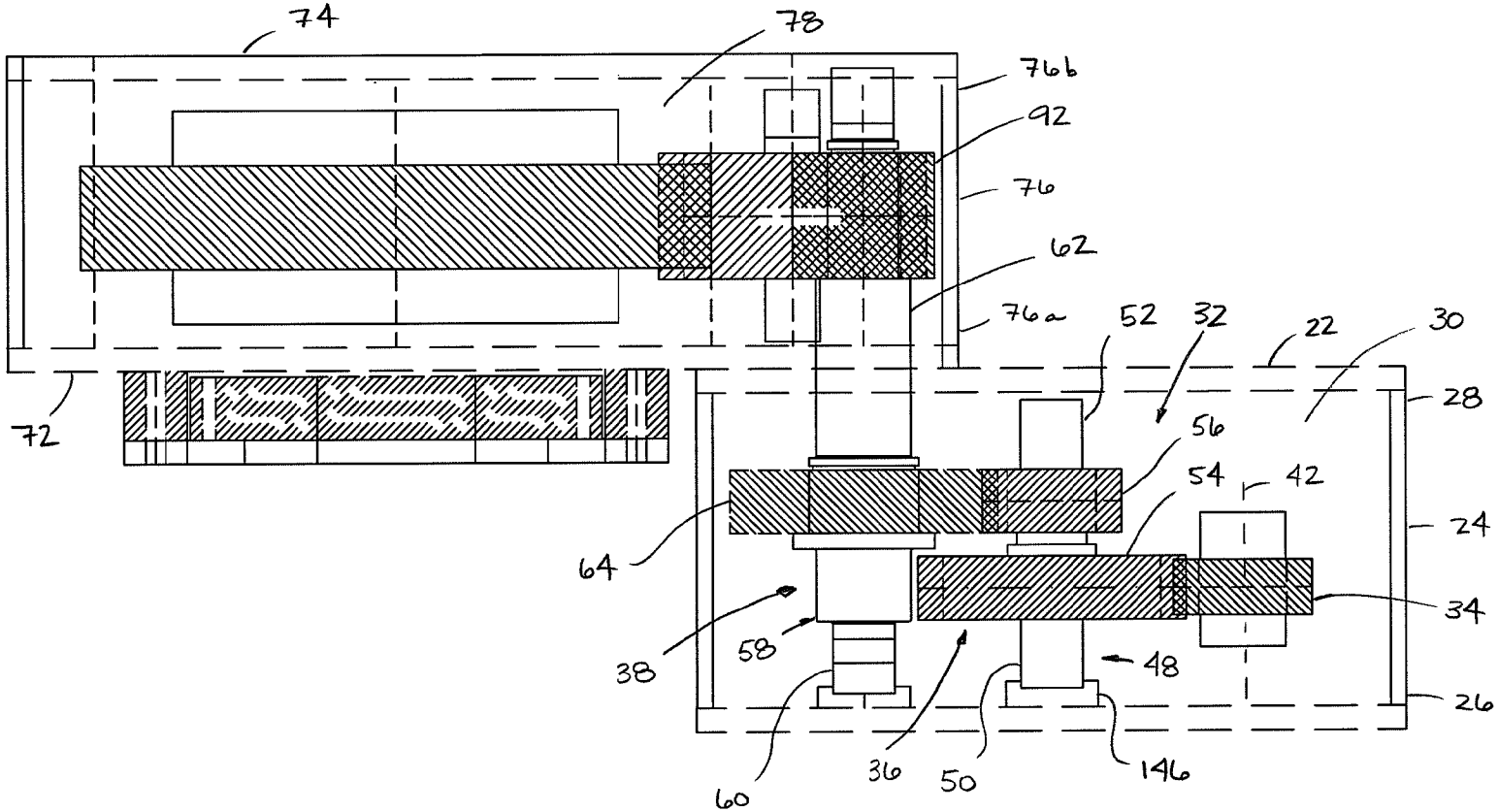
FIG. 3 is a side view of a transmission assembly and a case assembly suitable for use with the tong assembly of FIG. 1.
Figure 4:
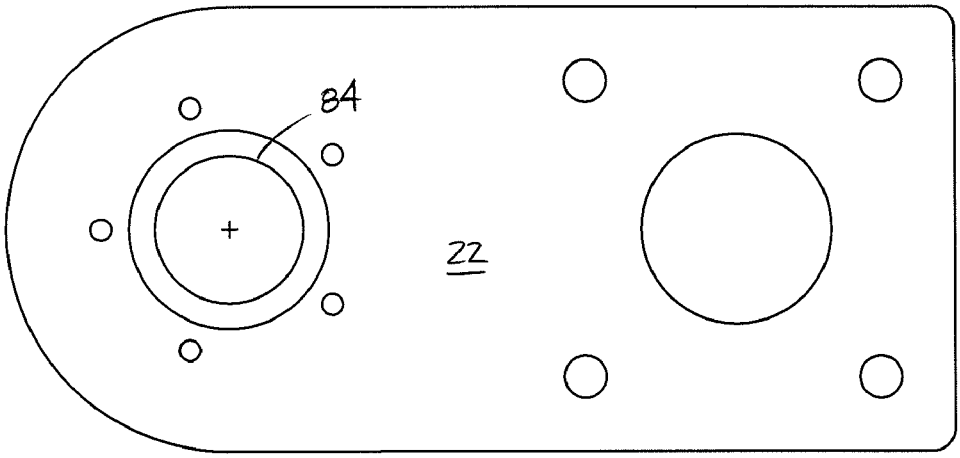
FIG. 4 is a top view of the cover plate of the transmission assembly.
Figure 5:
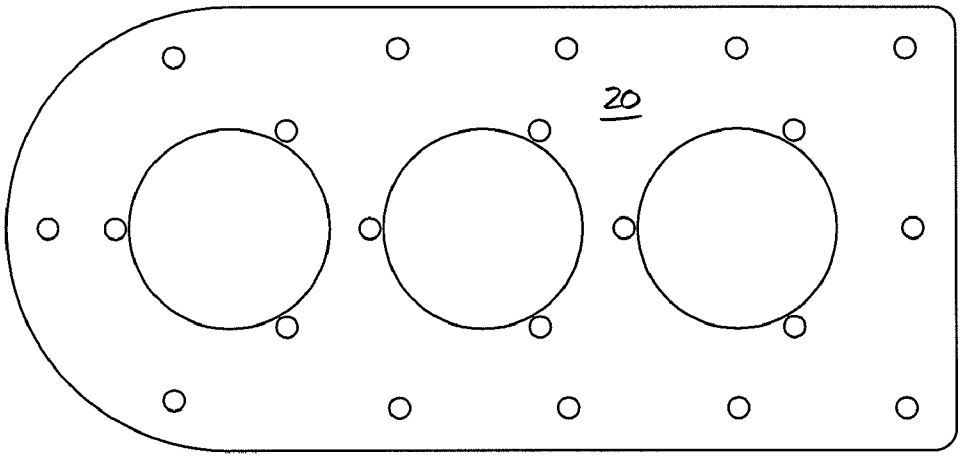
FIG. 5 is a top view of the base plate of the transmission assembly.
Figure 6:
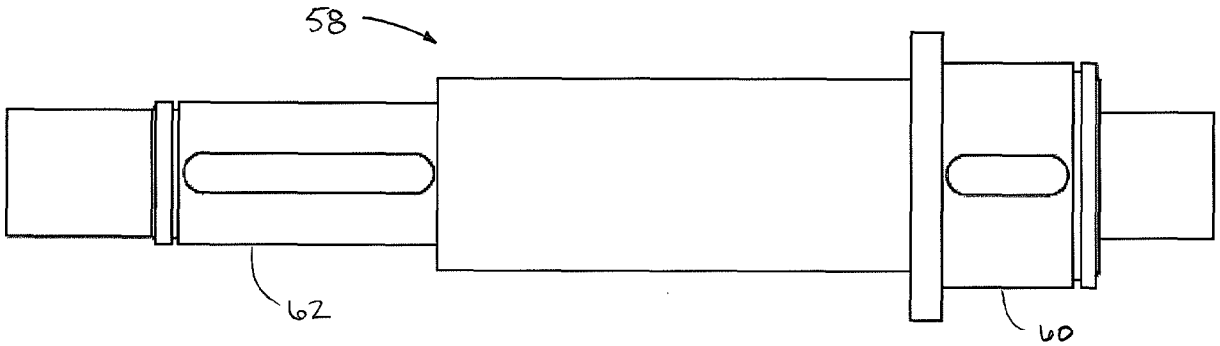
FIG. 6 is a side elevational view of a second shaft.
Figure 7:
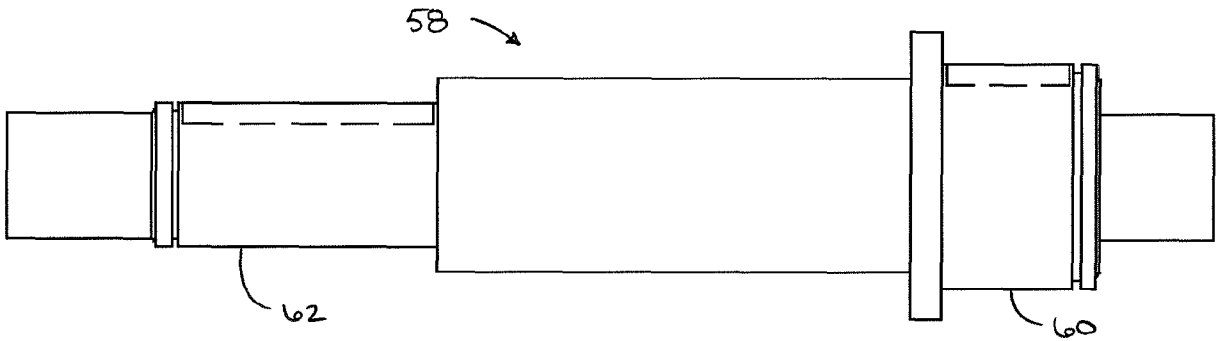
FIG. 7 is an alternate side view of the second shaft.
Figure 8:
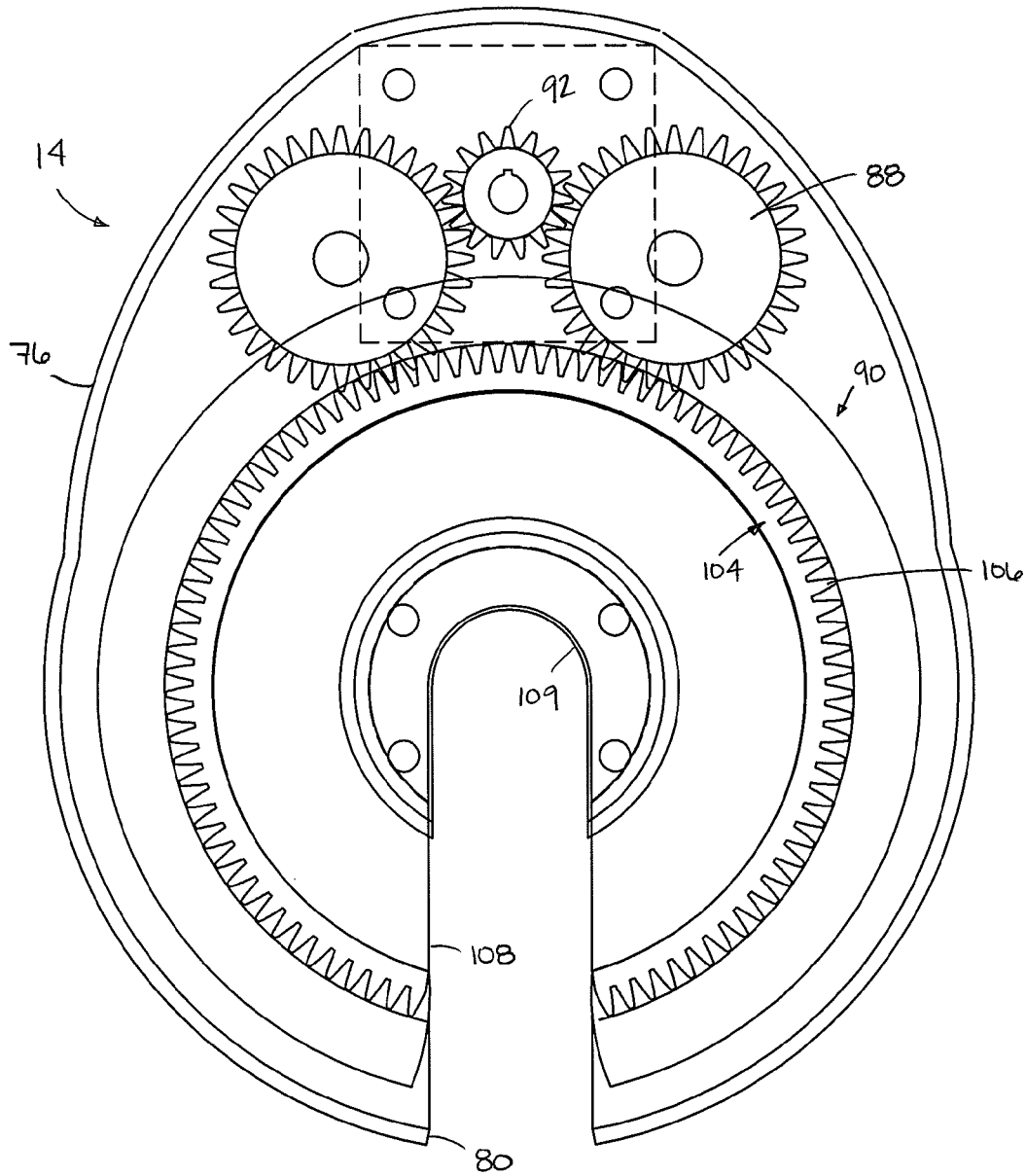
FIG. 8 is a top view of the case assembly of FIG. 2 with the cover removed.
Figure 9:
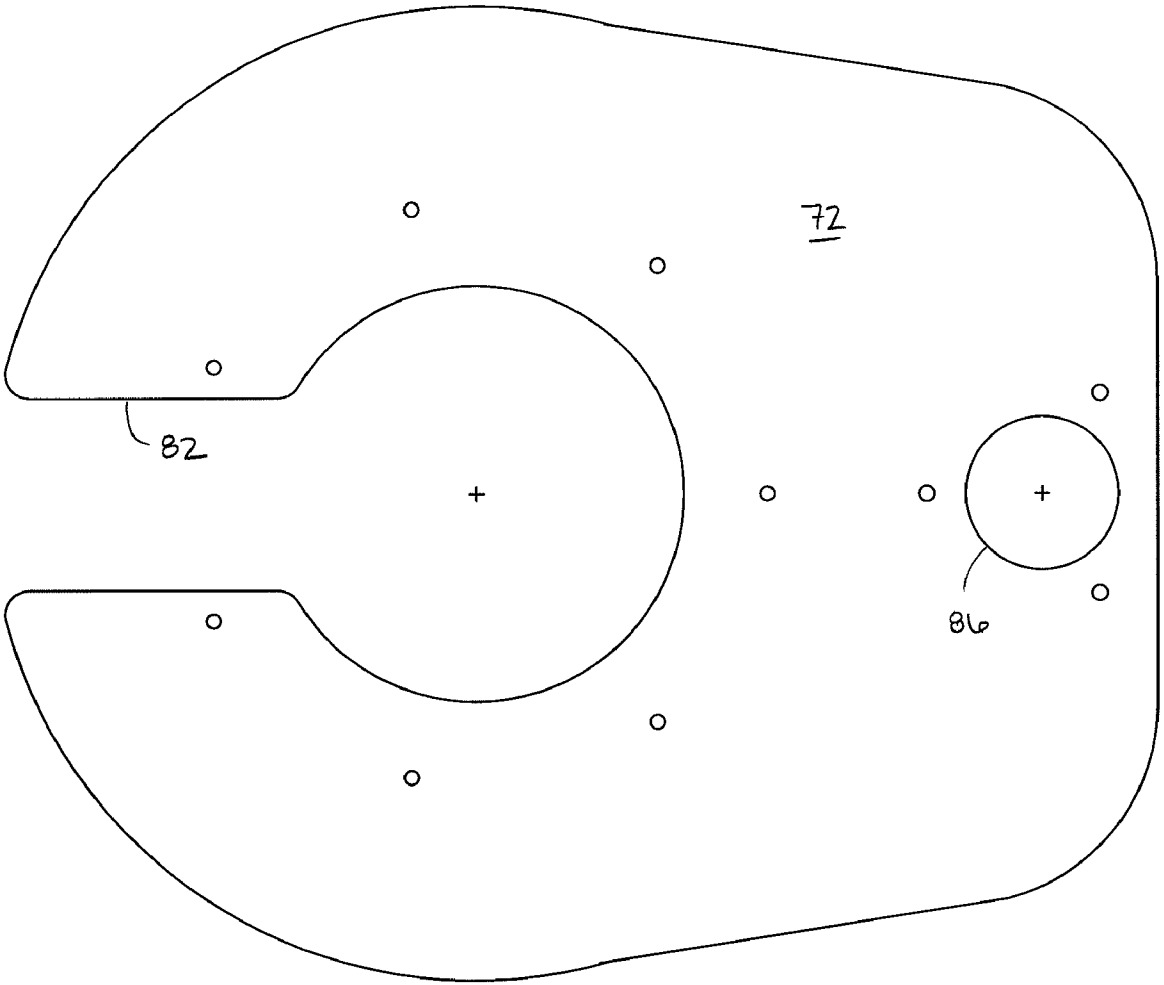
FIG. 9 is a view of the base of the case assembly of FIG. 8.
Figure 10:
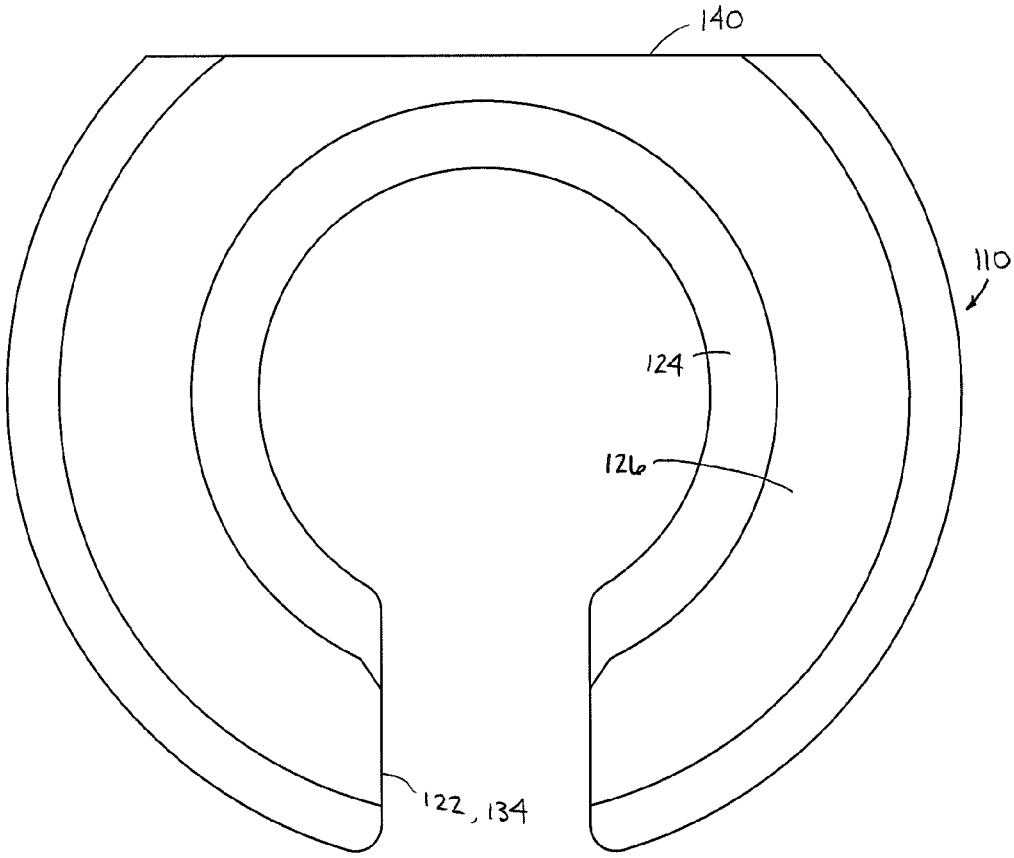
FIG. 10 is top view of a bearing assembly suitable for use with the case assembly of FIG. 8.
Figure 11:
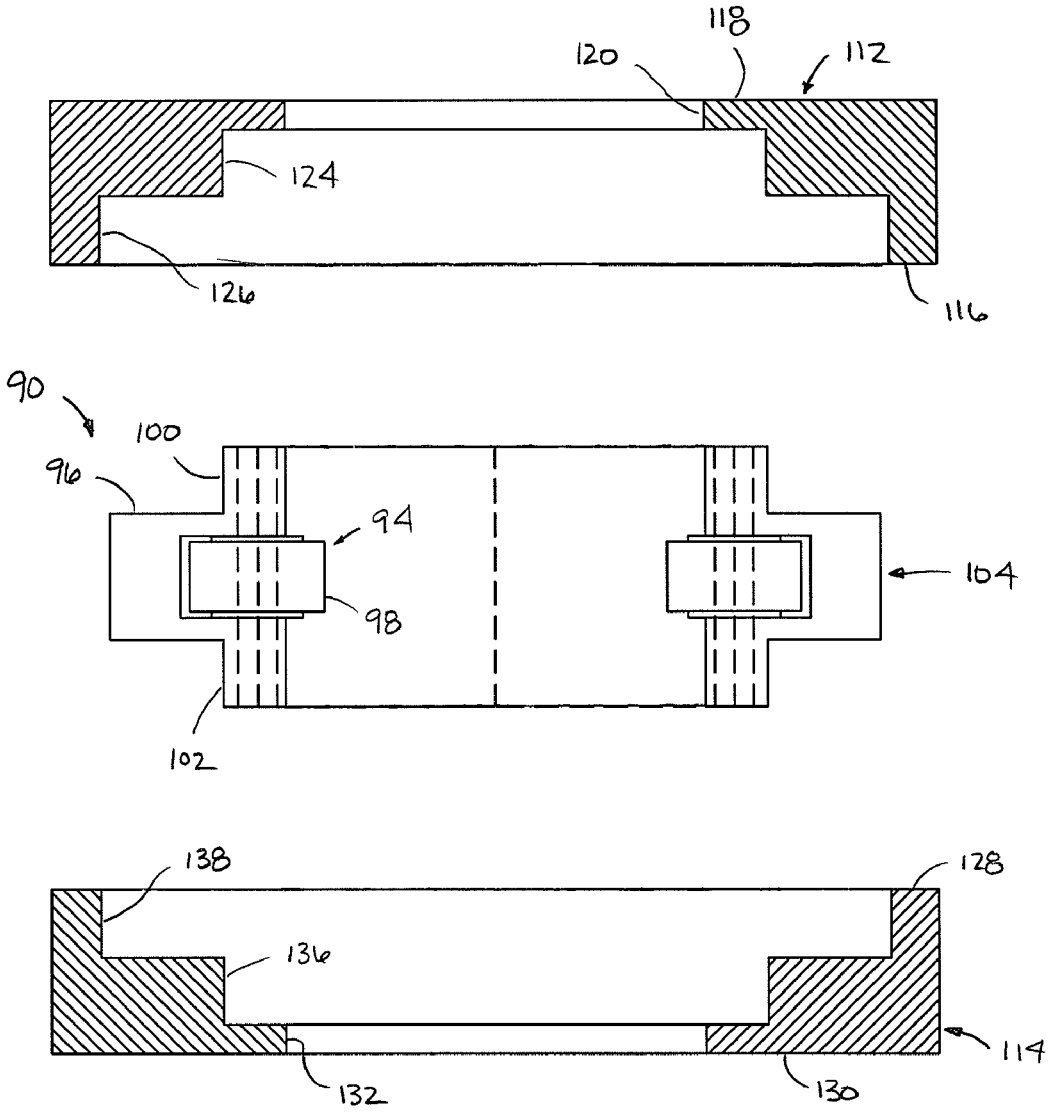
FIG. 11 is an exploded view of the bearing assembly of FIG. 10.
Figure 12:
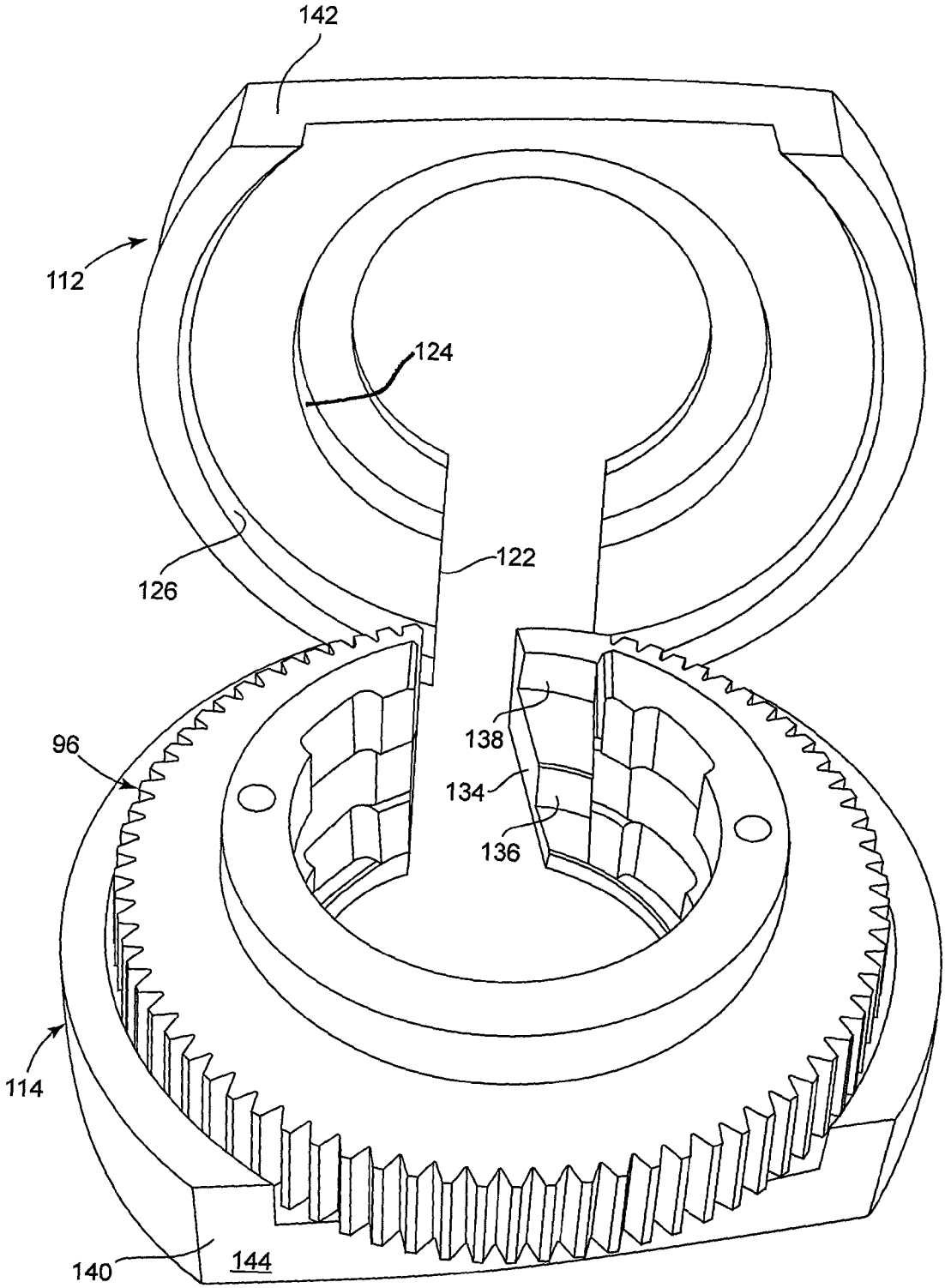
FIG. 12 is a perspective view of the bearing assembly and an outer ring gear.
Figure 13:
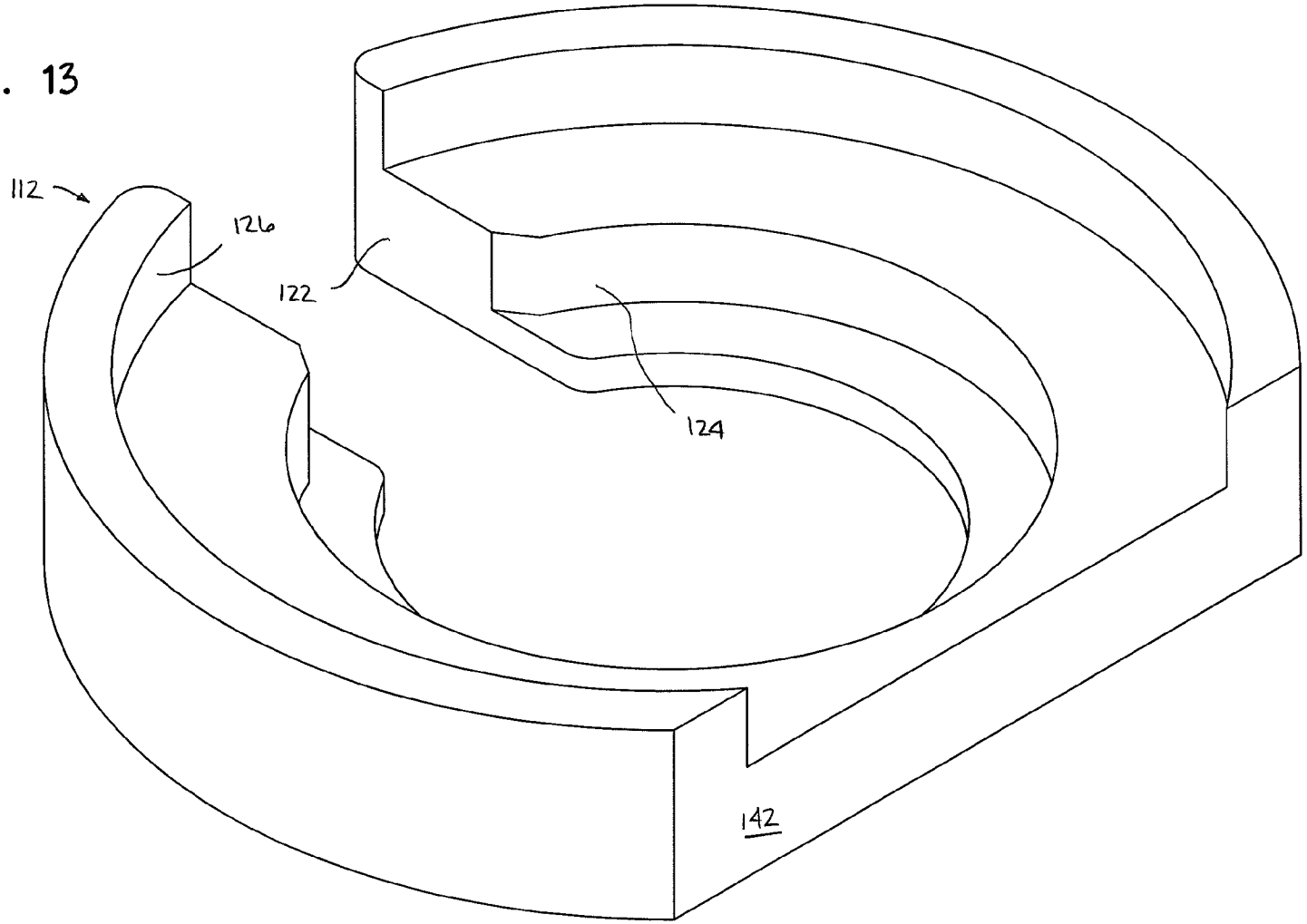
FIG. 13 is a perspective view of a first bearing member of the bearing assembly of FIG. 12.
Figure 14:
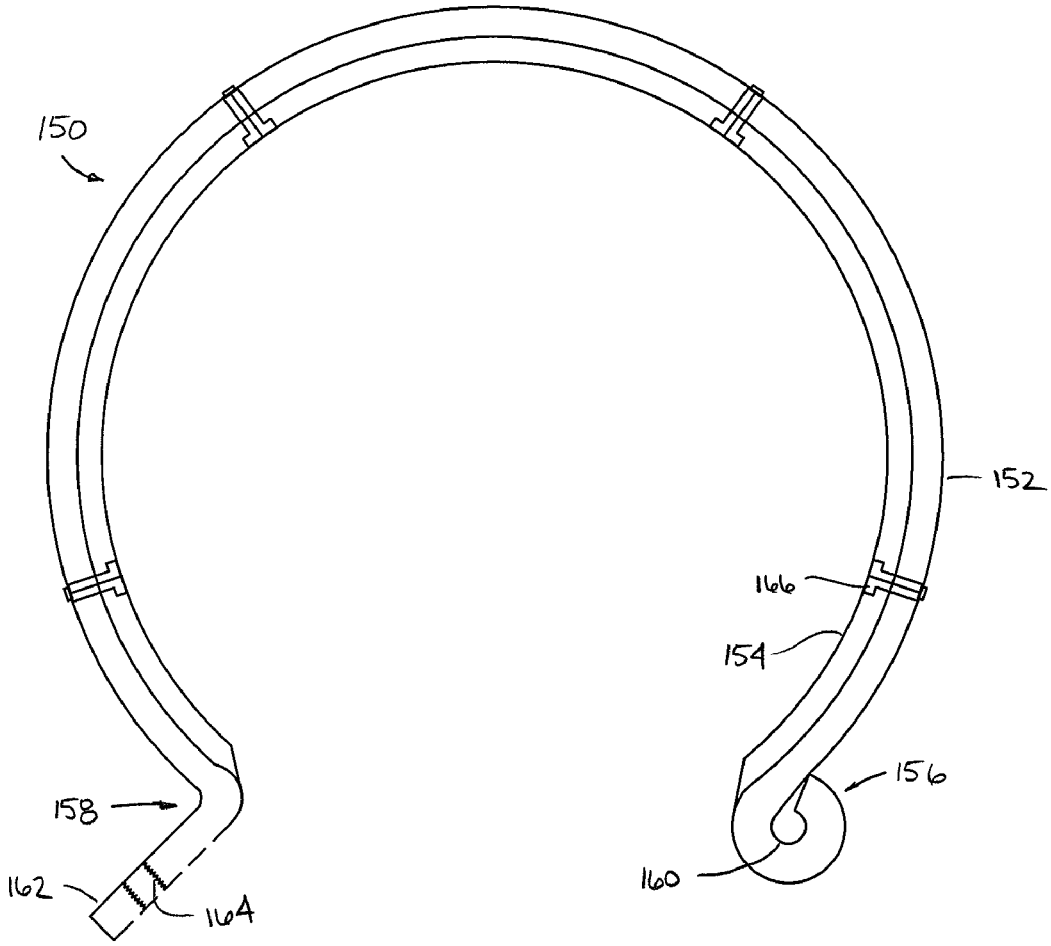
FIG. 14 is a top view of a band brake assembly suitable for use with the tong assembly of FIG. 1.

Referring now to FIGS. 1-3, a tong assembly, generally designated 10, is shown. In one aspect of the present disclosure, the tong assembly 10 is an open-head tong assembly. It will be understood, however, that the scope of the present disclosure is not limited to the tong assembly 10 being an open-head tong assembly as the tong assembly could alternatively be a closed-head tong assembly. The tong assembly 10 of the present disclosure is adapted for use with threaded tubulars, such as those commonly referred to as casing, tubing or "sucker" rods.

The tong assembly 10 includes a transmission assembly, generally designated 12, and a case assembly, generally designated 14. In one aspect of the present disclosure, a hydraulic motor 16 is engaged to the transmission assembly 12.

Referring now to FIGS. 2-7, the transmission assembly 12 includes an outer casing, generally designated 18. The outer casing 18 includes a base plate 20, a cover plate 22 and a sidewall 24 disposed between the base plate 20 and the cover plate 22. The sidewall 24 includes a first end 26 that is fastened (e.g., bolted, welded, etc.) to the base plate 20 and an oppositely disposed second end 28 that is fastened (e.g., bolted, welded, etc.) to the cover plate 22.

In one aspect of the present disclosure, the base plate 20, the cover plate 22 and the sidewall 24 are all manufactured from steel plate. While it will be appreciated that other materials such as cast steel, ductile iron, or similar materials could be used to manufacture the base plate 20, the cover plate 22 and the sidewall 24, steel plate may be preferred because of its strength, the relative ease with which plate steel can be modified, and the low costs associated with initial volume production.

The base plate 20, the cover plate 22 and the sidewall 24 cooperatively define an interior region 30 of the outer casing 18. A gear assembly 32 is disposed in the interior region 30 of the outer casing 18. In one aspect of the present disclosure, the gear assembly 32 includes a motor pinion gear 34, a first gear set 36 and a second gear set 38.

The motor pinion gear 34 includes a plurality of exterior gear teeth 40. The motor pinion gear 34 defines a central longitudinal axis 42 and a bore 44 that extends along the central longitudinal axis 42. The bore 44 of the motor pinion gear 34 is adapted for engagement with a shaft of the hydraulic motor 16. The bore 44 includes a notch 46 that is adapted for keyed engagement with the shaft.

The first gear set 36 includes a first shaft 48 having a first end 50 and an oppositely disposed second end 52. A first gear 54 is disposed on the first shaft 48 between the first and second ends 50, 52 such that the first gear 54 and the first shaft 48 rotate in unison. In one aspect of the present disclosure, the first gear 54 is engaged with the motor pinion gear 34.

A second gear 56 is disposed on the first shaft 48 between the first gear 54 and the second end 52. The second gear 56 is disposed on the first shaft 48 such that the second gear 56 and the first shaft 48 rotate in unison.

In one aspect of the present disclosure, an outer diameter of the first gear 54 is greater than an outer diameter of the second gear 56 and an outer diameter of the motor pinion gear 34. In another aspect of the present disclosure, the first gear 54 includes more teeth than the second gear 56 and the motor pinion gear 34. As the first gear 54 has an outer diameter that is greater than the outer diameter of the motor pinion gear 34 and as the first gear 54 has more teeth than the motor pinion gear 34, the number of revolutions per minute of the first gear set 36 is less than the number of revolutions per minute of the motor pinion gear 34.

The second gear set 38 includes a second shaft 58 having a first end portion 60 and an oppositely disposed second end portion 62. An exemplary configuration of the second shaft 58 is provided in FIGS. 6-7. In one aspect of the present disclosure, the first end portion 60 of the second shaft 58 is disposed in the interior region 30 of the outer casing 18 of the transmission assembly 12 while the second end portion 62 is disposed in the case assembly 14.

A reduction gear 64 is disposed on the first end portion 60 of the second shaft 58 such that the reduction gear 64 and the second shaft 58 rotate in unison. The reduction gear 64 is engaged with the second gear 56 of the first gear set 36. In one aspect of the present disclosure, the reduction gear 64 has an outer diameter that is greater than the outer diameter of the second gear 56 of the first gear set 36 so that the revolutions per minute of second shaft 58 is less than the number of revolutions per minute of the first shaft 48.

Referring now to FIGS. 2, 3 and 8-11, the case assembly 14 is adapted to receive the sucker rod or pipe and to rotate that sucker rod or pipe in response to rotation of the hydraulic motor 16. The case assembly 14 includes an enclosure 70. The enclosure 70 includes a base 72, a cover 74 and a sidewall 76 that extends between the base 72 and the cover 74. In one aspect of the present disclosure, a first end **76*a* of the sidewall 76 is engaged (e.g., fastened, bolted, welded) with the base 72 while a second end 76*b* of the sidewall 76 is engaged (e.g., fastened, bolted, welded) with the cover 74. In one aspect of the present disclosure, the base 72, the cover 74 and the sidewall 76** are manufactured from steel plate.

The base 72, the cover 74 and the sidewall 76 of the enclosure 70 cooperatively define an interior 78. In one aspect of the present disclosure, the sidewall 76 defines an opening 80 through which the interior 78 can be accessed. The cover 74 defines a slot that is aligned with the opening 80 in the sidewall 76 and that extends inwardly toward a thru-hole of the cover 74. The base 72 defines a slot 82 that is generally aligned with the slot in the cover 74. The slot 82 of the base 72 extends inwardly toward a thru-hole 83 in the base 72. In one aspect of the present disclosure, the opening 80 in the sidewall 76, the slots in the cover 74 and the base 72 and the thru-holes 82 in the base 72 and the cover 74 are adapted to receive a sucker rod.

In one aspect of the present disclosure, the cover plate 22 of the transmission assembly 12 is mounted to the base 72 of the case assembly 14. The cover plate 22 defines a passage 84 (shown in FIG. 4) through which the second end portion 62 of the second shaft 58 passes. The base 72 of the case assembly 14 defines a thru-hole 86 that is aligned with the passage 84 of the cover plate 22 when the transmission assembly 12 is mounted to the case assembly 14. With the transmission assembly 12 mounted to the case assembly 14, the second end portion 62 of the second shaft 58 is disposed in the interior 78 of the case assembly 14.

In one aspect of the present disclosure, the case assembly 14 is configured as a gear driven case assembly 14. Alternatively, the case assembly 14 could be configured as a chain driven case assembly 14. An exemplary chain driven case assembly 14 is depicted in U.S. patent application Ser. No. 11/753,366, the disclosure of which is hereby incorporated by reference in its entirety.

In one aspect of the present disclosure, the case assembly 14 includes an idler gear 88 and a tong head assembly, generally designated 90, disposed in the interior 78 of the enclosure 70. In one aspect of the present disclosure, the case assembly 14 includes a plurality of idler gears 88.

The plurality of idler gears 88 is engaged with a pinion gear 92 disposed on the second end portion 62 of the second shaft 58 of the transmission assembly 12. The pinion gear 92 is mounted to the second end portion 62 of the second shaft 58 such that the pinion gear 92 and the second shaft 58 rotate in unison. In one aspect of the present disclosure, the pinion gear 92 has 21 teeth while each of the idler gears has 32 teeth.

The tong head assembly 90 includes a tong head 94 in connected engagement with an outer ring gear 96. In one aspect of the present disclosure, the tong head 94 includes a bushing 98 and a jaw. The bushing 98 and jaw are adapted to engage the sucker rod.

The outer ring gear 96 includes a first axial end portion 100, an oppositely disposed second axial end portion 102 and a central portion 104 disposed between the first and second axial end portions 100, 102. The first and second axial end portions 100, 102 are generally cylindrical in shape. In one aspect of the present disclosure, the central portion 104 defines an outer diameter that is generally greater than an outer diameter of the first and second axial end portions 100, 102.

The central portion 104 of the outer ring gear 96 includes a plurality of gear teeth 106. In one aspect of the present disclosure, the outer ring gear 96 includes 79 teeth. The gear teeth 106 of the outer ring gear 96 are adapted for engagement with the teeth on the idler gears 88. An exemplary tong head assembly 90 suitable for use with the tong assembly 10 is manufactured by BJ Services Company.

The outer ring gear 96 and the tong head 94 cooperate to define an open portion 108. The open portion 108 is a slot in the tong head assembly 90 that extends from the periphery to a center opening 109 of the tong head assembly 90. The open portion 108 of the tong head assembly 90 is provided so as to allow a sucker rod or pipe to be moved laterally relative to the tong head assembly 90 for insertion into and removal from the center opening 109, eliminating the need for lifting the tong head assembly 90 for insertion and removal of the pipe as required with closed-head tong assemblies.

Referring now to FIGS. 2, 3, 8, and 10-13, the outer ring gear 96 is disposed in a bearing assembly 110. In one aspect of the present disclosure, the bearing assembly 110 includes a first bearing member 112 and a second bearing member 114. In one aspect of the present disclosure, the first and second bearing members 112, 114 of the bearing assembly 110 are generally cylindrical in shape.

The first bearing member 112 includes a first axial end 116 and an oppositely disposed second axial end 118 and defines a thru-bore 120 that extends through the first and second axial ends 116, 118. The first bearing member 112 further defines a channel 122 that extends outwardly in a radial direction from the thru-bore 120 through an outer periphery of the first bearing member 112. The thru-bore 120 and the channel 122 of the first bearing member 112 allow the sucker rod or pipe to be inserted into or removed from the tong head assembly 90.

The first bearing member 112 further defines a first cavity 124 and a second cavity 126. In one aspect of the present disclosure, the thru-bore 120, the first cavity 124 and the second cavity 126 are coaxial.

The first cavity 124 is adapted to receive the first axial end portion 100 of the outer ring gear 96. When the channel 122 is aligned with the open portion 108 of the tong head assembly 90, the first bearing member 112 surrounds the surface of the first axial end portion 100 of the outer ring gear 96 at the outer diameter of the outer ring gear 96.

The inner diameter of the first cavity 124 is sized for a close-fit engagement with the first axial end portion 100 of the outer ring gear 96. In one aspect of the present disclosure, the radial clearance between the inner diameter of the first cavity 124 and the outer diameter of the first axial end portion 100 of the outer ring gear 96 is less than or equal to about 0.015 inches. In another embodiment, the radial clearance between the inner diameter of the first cavity 124 and the outer diameter of the first axial end portion 100 of the outer ring gear 96 is less than or equal to about 0.010 inches. In another embodiment, the radial clearance between the inner diameter of the first cavity 124 and the outer diameter of the first axial end portion 100 of the outer ring gear 96 is in a range of about 0.005 inches to about 0.015 inches. In one aspect of the present disclosure, grease is disposed between the inner diameter of the first cavity 124 and the outer diameter of the first axial end portion 100 of the outer ring gear 96.

The second cavity 126 is adapted to receive the central portion 104 of the outer ring gear 96. When the channel 122 is aligned with the open portion 108 of the tong head assembly 90, the first bearing member 112 surrounds at least a portion of the surface of the central portion 104 of the outer ring gear 96 at the outer diameter of the outer ring gear 96.

The inner diameter of the second cavity 126 is sized for a loose-fit with a portion of the central portion 104 of the outer ring gear 96. In one aspect of the present disclosure, the radial clearance between the inner diameter of the second cavity 126 and the outer diameter of the central portion 104 of the outer ring gear 96 is less than or equal to about 0.375 inches. In another aspect of the present disclosure, the radial clearance between the inner diameter of the second cavity 126 and the outer diameter of the central portion 104 of the outer ring gear 96 is less than or equal to about 0.25. In another aspect of the present disclosure, the radial clearance between the inner diameter of the second cavity 126 and the outer diameter of the central portion 104 of the outer ring gear 96 is in the range of about 0.1 to about 0.5 inches.

The second bearing member 114 includes a first axial end 128 and an oppositely disposed second axial end 130 and defines a thru-bore 132 that extends through the first and second axial ends 128, 130. The second bearing member 114 further defines a channel 134 that extends outwardly in a radial direction from the thru-bore 132 through an outer periphery of the second bearing member 114.

The second bearing member 114 further defines a first cavity 136 and a second cavity 138. In one aspect of the present disclosure, the thru-bore 132, the first cavity 136 and the second cavity 138 are coaxial.

The first cavity 136 is adapted to receive the second axial end portion 102 of the outer ring gear 96. When the channel 134 is aligned with the open portion 108 of the tong head assembly 90, the second bearing member 114 surrounds the surface of the second axial end portion 102 of the outer ring gear 96 at the outer diameter of the outer ring gear 96.

The inner diameter of the first cavity 136 of the second bearing member 114 is sized for a close-fit engagement with the second axial end portion 102 of the outer ring gear 96. In one aspect of the present disclosure, the radial clearance between the inner diameter of the first cavity 136 of the second bearing member 114 and the outer diameter of the second axial end portion 102 of the outer ring gear 96 is less than or equal to about 0.015 inches. In another embodiment, the radial clearance between the inner diameter of the first cavity 136 of the second bearing member 114 and the outer diameter of the second axial end portion 102 of the outer ring gear 96 is less than or equal to about 0.010 inches. In another embodiment, the radial clearance between the inner diameter of the first cavity 136 of the second bearing member 114 and the outer diameter of the second axial end portion 102 of the outer ring gear 96 is in a range of about 0.005 inches to about 0.015 inches. In one aspect of the present disclosure, grease is disposed between the inner diameter of the first cavity 136 of the second bearing member 114 and the outer diameter of the second axial end portion 102 of the outer ring gear 96.

The second cavity 138 of the second bearing member 114 is adapted to receive at least a portion of the central portion 104 of the outer ring gear 96. When the channel 134 is aligned with the open portion 108 of the tong head assembly 90, the second bearing member 114 surrounds at least a portion of the surface of the central portion 104 of the outer ring gear 96 at the outer diameter of the outer ring gear 96.

The inner diameter of the second cavity 138 of the second bearing member 114 is sized for a loose-fit with the portion of the central portion 104 of the outer ring gear 96. In one aspect of the present disclosure, the radial clearance between the inner diameter of the second cavity 138 of the second bearing member 114 and the outer diameter of the central portion 104 of the outer ring gear 96 is less than or equal to about 0.375 inches. In another aspect of the present disclosure, the radial clearance between the inner diameter of the second cavity 138 of the second bearing member 114 and the outer diameter of the central portion 104 of the outer ring gear 96 is less than or equal to about 0.25. In another aspect of the present disclosure, the radial clearance between the inner diameter of the second cavity 138 of the second bearing member 114 and the outer diameter of the central portion 104 of the outer ring gear 96 is in the range of about 0.1 to about 0.5 inches.

With the tong head assembly 90 disposed in the first and second bearing members 112, 114, the thru-bores 120, 132 of the first and second bearing members 112, 114 are aligned with the center opening 109 of the tong head assembly 90.

In one aspect of the present disclosure, the first and second bearing members 112, 114 of the bearing assembly 110 cooperatively define a gear opening 140. The gear opening 140 provides access to the second cavities 126, 138 of the first and second bearing members 112, 114. In one aspect of the present disclosure, the gear opening 140 provides access to only the second cavities 126, 138 of the first and second bearing members 112, 114. As the central portion 104 of the outer ring gear 96 is disposed in the second cavities 126, 138 of the first and second bearing members 112, 114, the gear opening 140 provides access to the central portion 104 of the outer ring gear 96. In one aspect of the present disclosure, the idler gears 88 engage the gear teeth 106 of the central portion 104 of the outer ring gear 96 through the gear opening 140 of the bearing assembly 110.

The gear opening 140 is defined by a first end 142 of the first bearing member 112 and a first end 144 of the second bearing member 114. In one aspect of the present disclosure, the first ends 142, 144 of the first and second bearing members 112, 114 are generally planar. In one aspect of the present disclosure, the gear opening 140 is disposed opposite the channels 122, 134 of the first and second bearing members 112, 114, respectively.

The bearing assembly 110 is engaged to the enclosure 70 of the case assembly 14. In one aspect of the present disclosure, the first bearing member 112 is engaged (e.g., fastened, bolted, pinned, keyed, etc.) to the cover 74 of the case assembly 14 while the second bearing member 114 is engaged (e.g., fastened, bolted, pinned, keyed, etc.) to the base 72 of the case assembly 14. The engagement between the bearing assembly 110 and the enclosure 70 of the case assembly 14 prevents rotation of the bearing assembly 110 relative to the enclosure 70.

In one aspect of the present disclosure, the first and second bearing members 112, 114 are manufactured from a synthetic material. In another aspect of the present disclosure, the first and second bearing members 112, 114 are manufactured from a synthetic polymer (e.g., polyethylene, polyamide (e.g., Nylon), polytetrafluoroethylene (e.g., Teflon), etc.). In another aspect of the present disclosure, the first and second bearing members 112, 114 are manufactured from a phenolic material. Phenolic materials are manufactured by reacting phenols with simple aldehydes (e.g., formaldehyde, etc.). Phenolic material suitable for use in the bearing assembly 110 is sold by Scan-Pac Mfg., Inc. under the product name "Gatke."

Referring now to FIG. 3, in one aspect of the present disclosure, a bearing cap 146 is disposed on each of the first and second ends 50, 52 of the first shaft 48 and each of the first and second end portions 60, 62 of the second shaft 58. The bearing caps 146 disposed on the first shaft 48 are engaged with the outer casing 18 of the transmission assembly 12. The bearing cap disposed on the first end portion 60 of the second shaft 58 is engaged with the outer casing 18 of the transmission assembly 12. The bearing cap 146 disposed on the second end portion 62 of the second shaft 58 is engaged with the cover 74 of the enclosure 70 of the case assembly 14. In one aspect of the present disclosure, the bearing caps 146 are made of a synthetic polymer material. In another aspect of the present disclosure, the bearing caps 146 are made of a phenolic material. In another aspect of the present disclosure, the bearing caps 146 are made of the same material as the first and second bearing members 112, 114.

Referring now to FIGS. 1-3 and 14, a brake band assembly 150 is shown. The brake band assembly 150 is adapted for engagement with the base 72 of the enclosure 70 of the case assembly 14. In one aspect of the present disclosure, the brake band assembly 150 is generally "C" shaped and adapted to receive the sucker rod or pipe when the sucker rod or pipe is disposed in the center opening 109 of the tong head assembly 90. In one aspect of the present disclosure, the brake band assembly 150 is disposed below the slot 82 in the base 72 of the enclosure 70 so that the brake band assembly 150 is generally aligned with the center opening 109 of the tong head assembly 90.

The brake band assembly 150 includes an outer band 152 and an inner band 154. In one aspect of the present disclosure, the outer band 152 is made of a steel material while the inner band 154 is made of a synthetic polymer such as nylon.

The outer band 152 includes a first end portion 156 and an oppositely disposed second end portion 158. The first end portion 156 defines an anchor opening 160. The anchor opening 160 is adapted to receive an anchor pin that is engaged to the base 72 of the enclosure 70.

The second end portion 158 includes a tab 162 defining an adjustment opening 164. In the subject embodiment, the adjustment opening 164 is a threaded opening that is adapted for threaded engagement with a threaded fastener. As the threaded fastener is engaged with the adjustment opening 164, the inner diameter of the band brake assembly 150 reduces in size.

The inner band 154 is engaged with the outer band 152 through a plurality of fasteners 166 (e.g., bolts, screws, etc.). In one aspect of the present disclosure, the inner band 154 is adapted to be replaceable. The inner band 154 is adapted to grip the sucker rod or pipe as the threaded fastener is tightened in the adjustment opening 164.

Referring now to FIG. 1, the tong assembly 10 includes control system, generally designated 170. The control system 170 includes the hydraulic motor 16, a hydraulic control valve 172 and a pneumatic shift valve 174.

In one aspect of the present disclosure, the pneumatic shift valve 174 is actuated by a handle 176. With the handle 176 in a first position, pressurized air is routed to the hydraulic control valve 172. The pressurized air pilots the hydraulic control valve 172 such that the hydraulic control valve 172 provides fluid communication between a fluid source and the hydraulic motor 16. With the handle 176 in a second position, pressurized air is routed to the hydraulic control valve 172 and pilots the hydraulic control valve 172 such that fluid communication between the fluid source and the hydraulic motor 16 is ceased. In an alternate embodiment, with the handle 176 in the second position, pressurized air acting on the hydraulic control valve 172 is vented and a spring actuates the hydraulic control valve 172 such that fluid communication between the fluid source and the hydraulic motor 16 is ceased.

Figure 15:
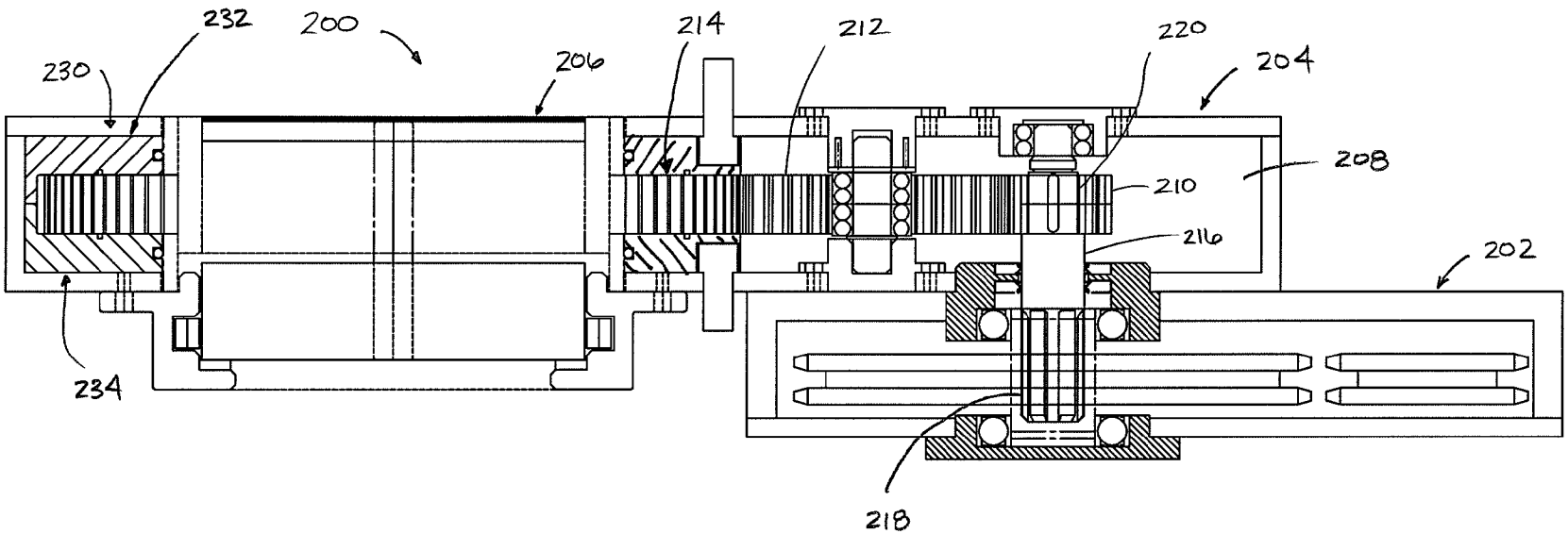
FIG. 15 is a cross-sectional view of an alternate embodiment of a tong assembly.
Figure 16:
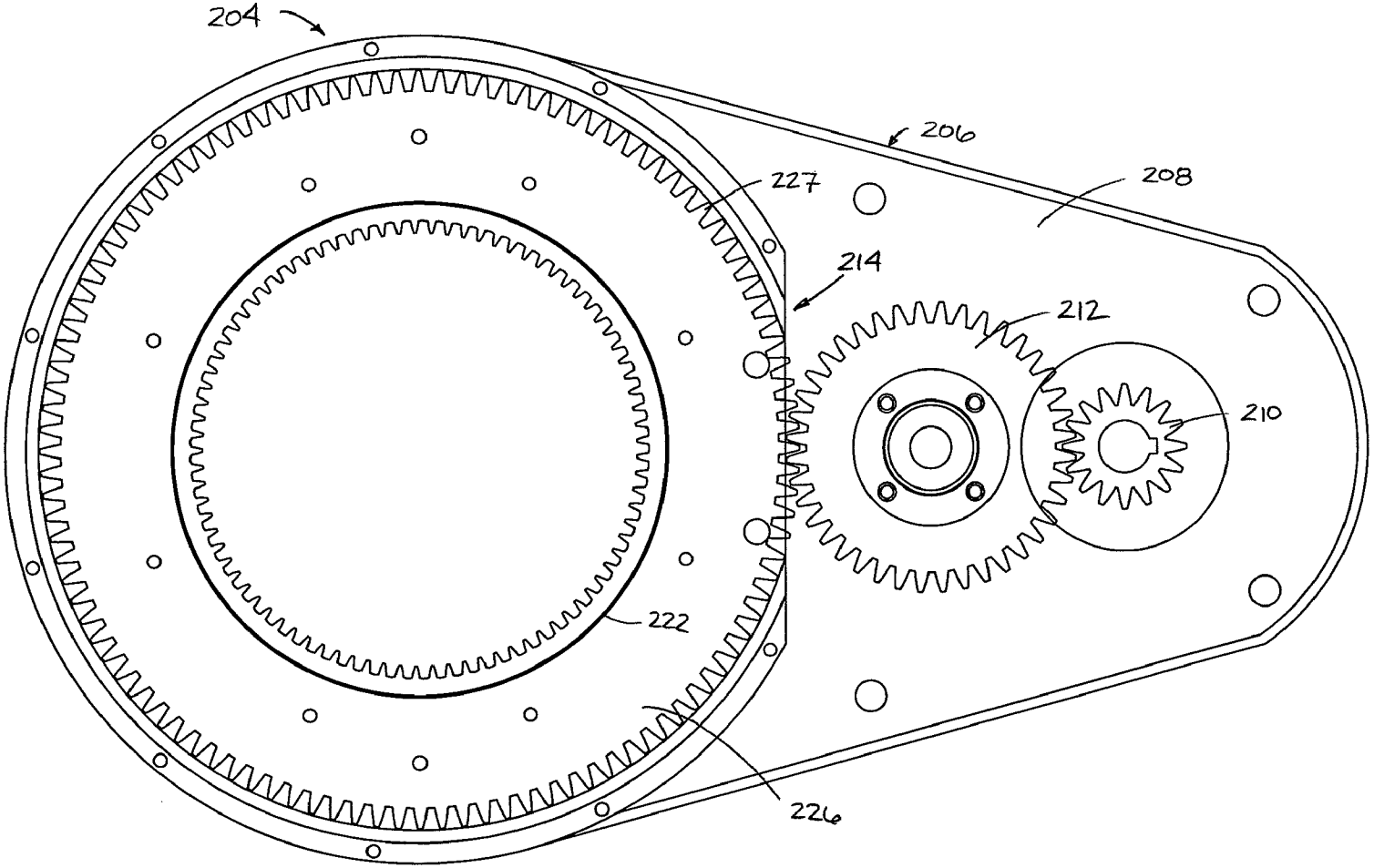
FIG. 16 is a top view of a case assembly of the tong assembly of FIG. 15 with a cover removed.

Referring now to FIGS. 15 and 16, an alternate embodiment of a tong assembly 200 is shown. In the depicted embodiment, the tong assembly 200 is configured as a tubing tong. The tong assembly 200 includes a transmission assembly 202 and a case assembly 204.

The case assembly 204 includes an enclosure 206 that defines an interior region 208. In the depicted embodiment, a pinion gear 210, an idler gear 212 and an outer ring gear 214 are disposed in the interior region 208.

The pinion gear 210 is engaged to a shaft 216 so that the pinion gear 210 and the shaft 216 rotate in unison. The shaft 216 includes a first end portion 218 disposed in the transmission assembly 202 and a second end portion 220 disposed in the interior region 208 of the case assembly 204. In the subject embodiment, the shaft 216 is rotated by a hydraulic motor through a gear set or a chain and sprocket configuration.

The pinion gear 210 is engaged with the idler gear 212. In the depicted embodiment, the outer diameter of the idler gear 212 is greater than the outer diameter of the pinion gear 210 so the idler gear 212 rotates at a slower rotation speed than the pinion gear 210.

Figure 17:
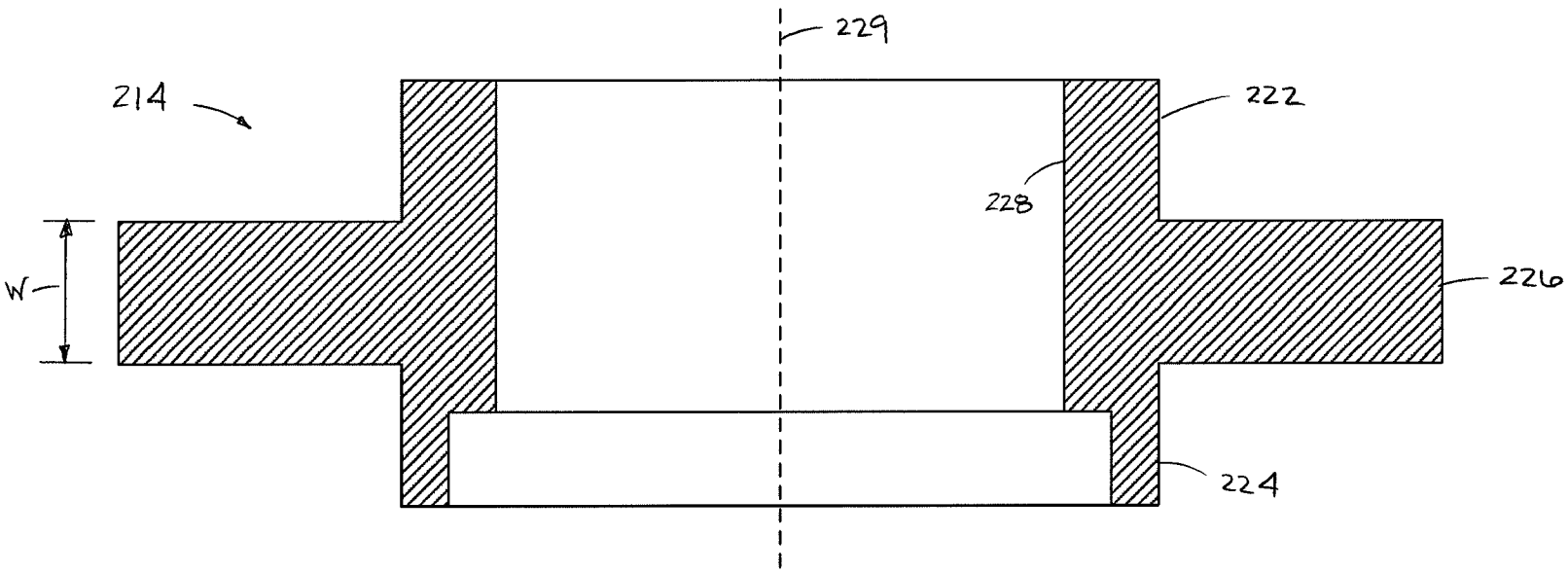
FIG. 17 is a cross-sectional view of an outer ring gear suitable for use with the tong assembly of FIG. 15.
Figure 19:
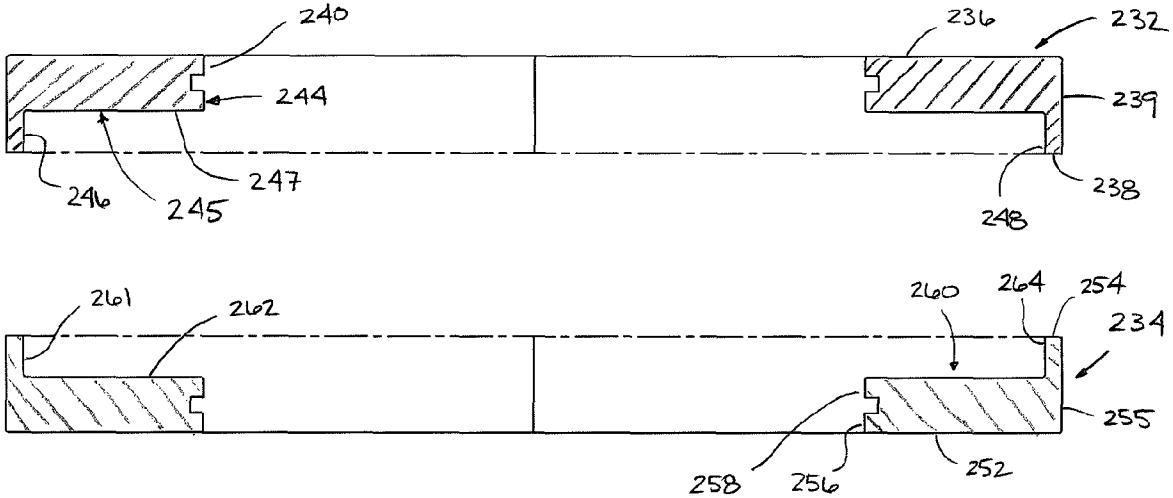
FIG. 19 is an exploded cross-sectional view of the bearing assembly of FIG. 18.
Figure 18:
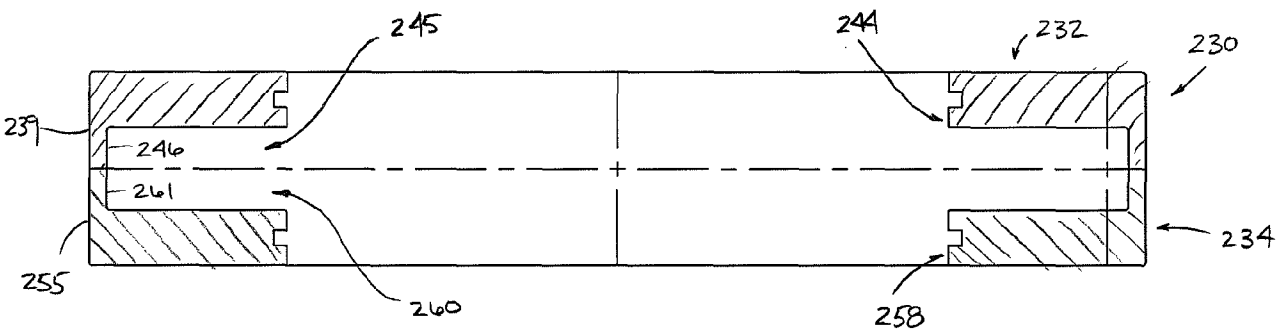
FIG. 18 is a cross-sectional view of a bearing assembly suitable for use with the outer ring gear of FIG. 17.

Referring now to FIGS. 16 and 17, the idler gear 212 is engaged with the outer ring gear 214. The outer ring gear 214 includes a first axial end portion 222, an oppositely disposed second axial end portion 224 and an external gear portion 226 disposed between the first and second axial end portions 222, 224. The external gear portion 226 has an outer diameter that is greater than outer diameters of the first and second axial end portions 222, 224. The external gear portion 226 includes a plurality of external teeth 227 that is engaged with a plurality of teeth of the idler gear 212.

The outer ring gear 214 defines a central bore 228 that extends through the first and second axial end portions 222, 224 along a central axis 229 that extends through the centers of the first and second axial end portions 222, 224. The central bore 228 is adapted to receive a pipe.

Referring now to FIGS. 15 and 17-20, the case assembly 202 further includes a bearing assembly 230. In one aspect of the present disclosure, the bearing assembly 230 includes a first bearing member 232 and a second bearing member 234. In one aspect of the present disclosure, the first and second bearing members 232, 234 of the bearing assembly 230 are generally cylindrical in shape.

The first bearing member 232 includes a first axial end 236 and an oppositely disposed second axial end 238. The first bearing member 232 further includes an outer surface 239. In the depicted embodiment, the outer surface 239 is generally cylindrical in shape.

The first bearing member 232 defines a thru-bore 240 that extends through the first and second axial ends 236, 238. The first bearing member 232 further defines a first cavity 244 and a second cavity 245. In the depicted embodiment, the first cavity 244 has an inner diameter that is less than an inner diameter of the second cavity 245. The second cavity 245 includes an inner surface 246 that extends from the second axial end 238 to a base wall 247 of the second cavity 245.

The first cavity 244 is disposed adjacent to the first axial end 236 while the second cavity 245 is disposed adjacent to the second axial end 238. The second axial end 238 defines an opening 248 to the second cavity 245. In one aspect of the present disclosure, the thru-bore 240, the first cavity 244 and the second cavity 245 are coaxial.

The first cavity 244 is adapted to receive the first axial end portion 222 of the outer ring gear 214. The second cavity 245 is adapted to receive a first portion of a width W of the external gear portion 226, where the width W is measure in an axial direction that is parallel to the central axis 229. In the subject embodiment, the first portion of the width of the external gear portion 226 is equal to about half of the width W of the external gear portion 226.

Figure 20:
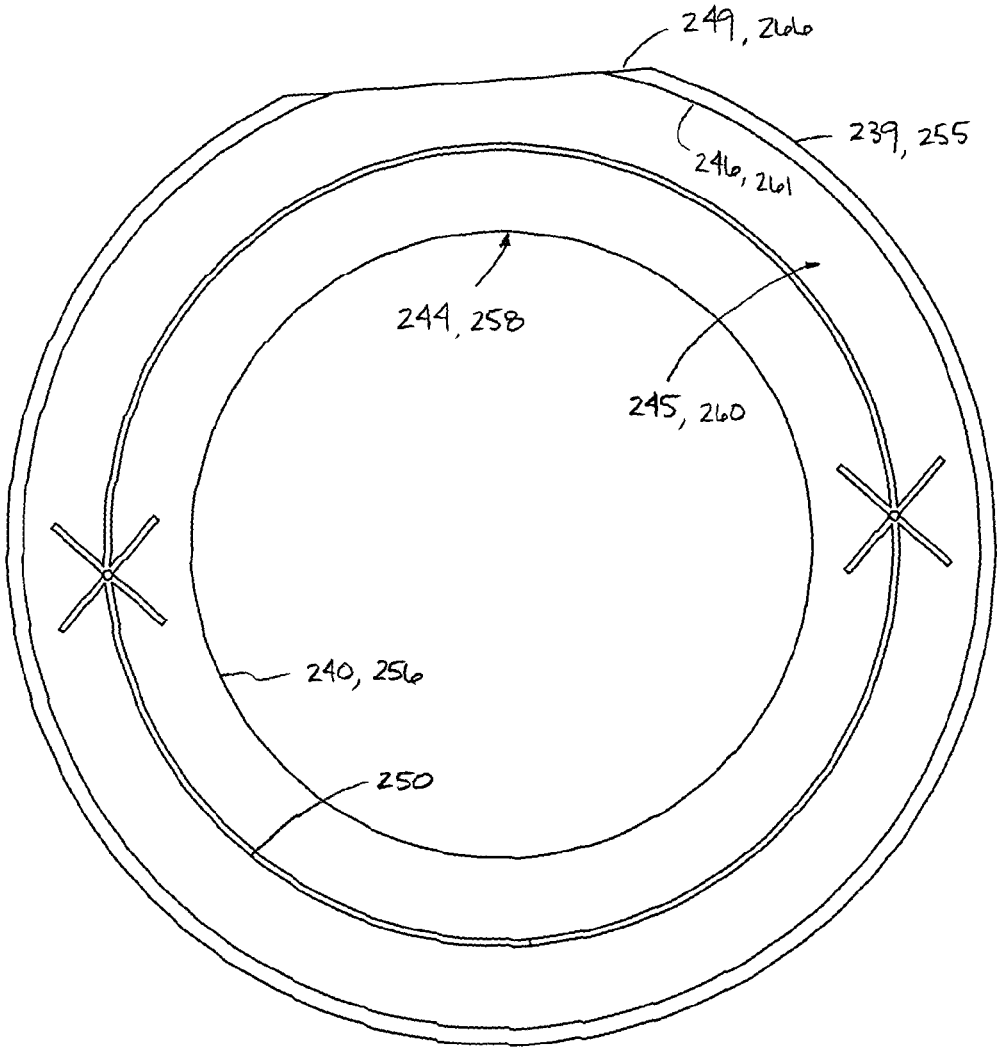
FIG. 20 is bottom view of a bearing member of the bearing assembly of FIG. 18.

In the subject embodiment, the first bearing member 232 defines a first gear access opening 249 (best shown in FIG. 20). The gear access opening 249 extends through the outer surface 239 of the first bearing member 232 and through the inner surface 246 of the second cavity 245 of the first bearing member 232. The gear access opening 249 is adapted to provide access to the external teeth 227 of the external gear portion 226 of the outer ring gear 214.

In the depicted embodiment of FIG. 20, the first bearing member 232 defines a channel 250 disposed between the first and second cavities 244, 245. The channel 250 is adapted to receive a lubricant (e.g., grease, oil, etc.).

Referring now to FIGS. 15 and 17-20, the second bearing member 234 includes a first axial end 252 and an oppositely disposed second axial end 254. The second bearing member 234 further includes an outer surface 255. In the depicted embodiment, the outer surface 255 is generally cylindrical in shape.

The second bearing member 234 defines a thru-bore 256 that extends through the first and second axial ends 252, 254. The second bearing member 234 further defines a first cavity 258 and a second cavity 260. In the depicted embodiment, the first cavity 258 has an inner diameter that is less than an inner diameter of the second cavity 260. The second cavity 260 includes an inner surface 261 that extends from the second axial end 254 to a base wall 262 of the second cavity 260.

The first cavity 258 is disposed adjacent to the first axial end 252 while the second cavity 260 is disposed adjacent to the second axial end 254. The second axial end 254 defines an opening 264 to the second cavity 260.

The first cavity 258 of the second bearing member 234 is adapted to receive the second axial end portion 224 of the outer ring gear 214. The second cavity 260 of the second bearing member 234 is adapted to receive a second portion of the width W of the external gear portion 226. In the subject embodiment, the second portion of the width W of the external gear portion 226 is equal to the remaining portion of the width W of the external gear portion 226. In another embodiment, the second portion of the width W is equal to about half of the width W of the external gear portion 226.

In the subject embodiment, the second bearing member 234 defines a second gear access opening 266 (similar to the first gear access opening shown in FIG. 20). The second gear access opening 266 extends through the outer surface 255 of the second bearing member 234 and through the inner surface 261 of the second cavity 260 of the second bearing member 234.

The bearing assembly 230 is oriented in the case assembly 202 so that the second axial end 238 of the first bearing member 232 is disposed adjacent to the second axial end 254 of the second bearing member 234. In one embodiment, the second axial end 238 of the first bearing member 232 contacts the second axial end 254 of the second bearing member 234. With the second axial ends 238, 254 of the first and second bearing members 232, 234 adjacently disposed, the first and second gear access openings 249, 266 are aligned. The first and second gear access openings 249, 266 are adapted to provide access to the external teeth 227 of the external gear portion 226 of the outer ring gear 214.

Figure 21:
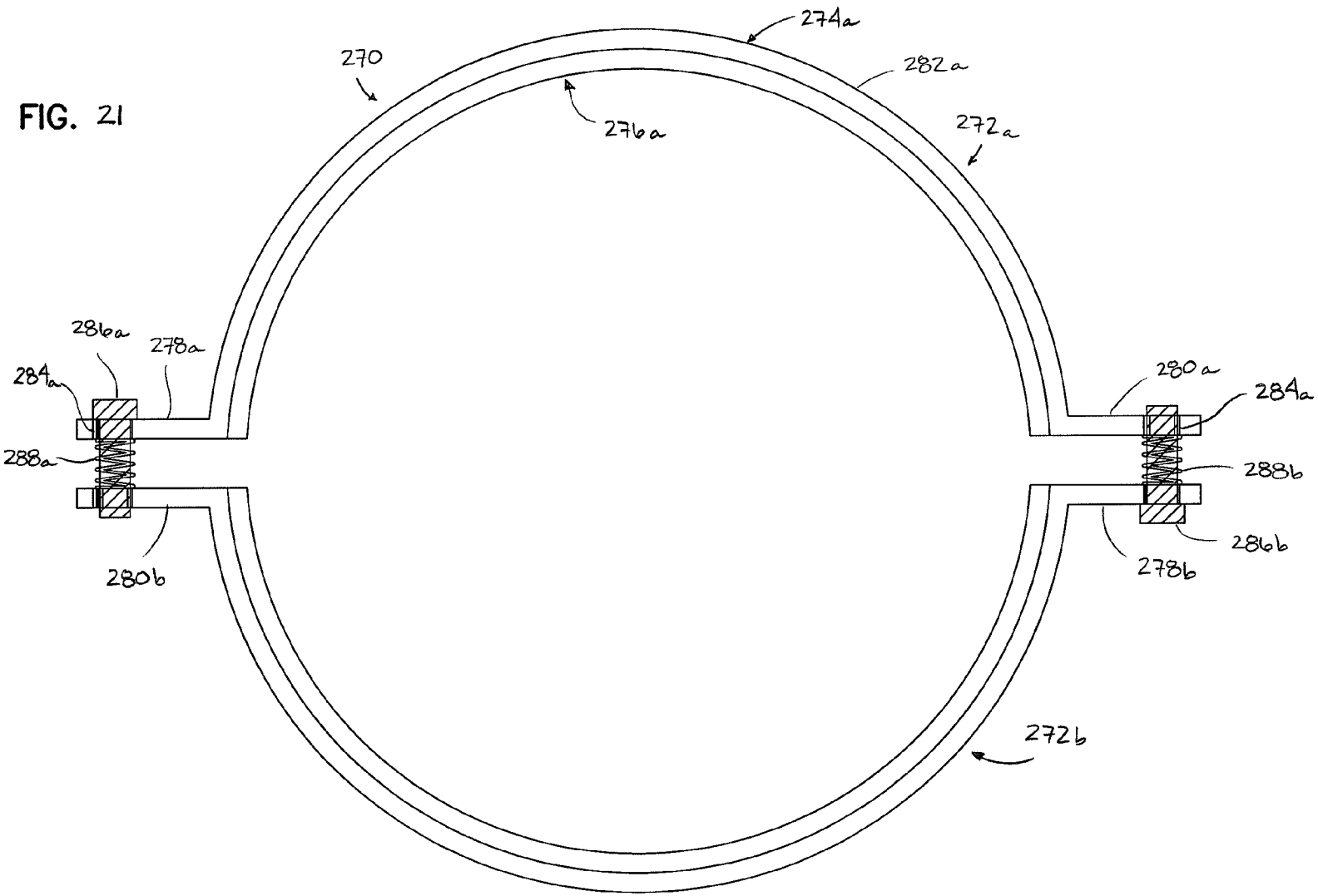
FIG. 21 is a top view of a band brake assembly suitable for use with the tong assembly of FIG. 15.

Referring now to FIG. 21, a band brake assembly 270 suitable for use with the tong assembly 200 is shown. In the depicted embodiment, the band brake assembly 270 includes a first band assembly 272*a* and a second band assembly 272*b*. As the first and second band assemblies 272*a*, 272*b* are substantially similar, only the first band assembly 272*a* will be described in detail for ease of description purposes only. Features of the first band assembly 272*a* include a reference numeral proceeded by the letter "a." Similar features of the second band assembly 272*b* will have the same reference numeral proceeded by the letter "b."

The first band assembly 272*a* includes an outer band 274*a* and an inner band 276*a*. The outer band 274*a* includes a first end 278*a*, an oppositely disposed second end 280*a*, and a central portion 282*a* disposed between the first and second ends 278*a*, 280*a*.

Each of the first and second ends 278*a*, 280*a* includes a hole 284*a* that is adapted to receive a fastener 286. In the depicted embodiment, the hole 284*a* of the first end 278*a* includes a plurality of internal threads while the hole 284*a* of the second end 280*a* is an unthreaded thru-hole.

The center portion 282*a* is arcuate in shape. In the subject embodiment, the center portion 282*a* has a radius. In the depicted embodiment of FIG. 21, the center portion 282*a* is semi-circular in shape.

The inner band 276*a* is engaged with the center portion 282*a* of the outer band 274*a*. The inner band 276*a* is adapted to grip a portion of the sucker rod or pipe.

The first band assembly 272*a* is engaged to the second band assembly 272*b* by first and second fasteners 286*a*, 286*b*. In the depicted embodiment, the radial force acting against the pipe increases as the first and second fasteners 286*a*, 286*b* are tightened. The increased radial force increases the friction between the inner bands 276*a*, 276*b* and the pipe.

The first and second band assemblies 272*a*, 272*b* are oriented so that the first end 278*a* of the first band assembly 272*a* is aligned with the second end 280*b* of the second band assembly 272*b* and the second end 280*a* of the first band assembly 272*a* is aligned with the first end 278*b* of the second band assembly 272*b*.

A first spring 288*a* is disposed between the first end 278*a* of the first band assembly 272*a* and the second end 280*b* of the second band assembly 272*b*. In the depicted embodiment, the first spring 288*a* is aligned with the holes 284*a*, 284*b* of the first and second band assemblies 272*a*, 272*b* so that the first fastener 286*a* passes through the first spring 288*a*.

A second spring 288*b* is disposed between the second end 280*a* of the first band assembly 272*a* and the first end 280*a* of the second band assembly 272*b*. In the depicted embodiment, the second spring 288*b* is aligned with the holes 284*b*, 284*a* of the first and second band assemblies 272*a*, 272*b* so that the second fastener 286*b* passes through the second spring 288*b*. The first and second springs 288*a*, 288*b* are adapted to separate the first and second band assemblies 272*a*, 272*b* when the first and second fasteners 286*a*, 286*b* are loosened.

In the depicted embodiment, the brake band assembly 270 is disposed external to the case assembly 202. This external disposition of the brake band assembly 270 allows for the brake band assembly 270 to be adjusted without having to open the case assembly 204.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A tong assembly comprising:

a case assembly including an enclosure defining an interior;

a bearing assembly disposed in the interior of the enclosure, the bearing assembly including a first bearing member defining a first cavity and a second bearing member defining a first cavity; and a tong head assembly disposed in the interior of the case assembly, the tong head assembly including a tong head engaged with an outer ring gear, the outer ring gear including a first axial end portion, an oppositely disposed second axial end portion and a central portion, the central portion including a plurality of gear teeth, wherein the first axial end portion is disposed in the first cavity of the first bearing member and the second axial end portion is disposed in the first cavity of the second bearing member.

2. A tong assembly as claimed in claim 1, wherein the first and second bearing members are a synthetic polymer.

3. A tong assembly as claimed in claim 2, wherein the first and second bearing members are made from a phenolic material.

4. A tong assembly as claimed in claim 1, wherein grease is disposed between an outer diameter of the first axial end portion of the outer ring gear and an inner diameter of the first cavity of the first bearing member.

5. A tong assembly as claimed in claim 4, wherein grease is disposed between an outer diameter of the second axial end portion of the outer ring gear and an inner diameter of the first cavity of the second bearing member.

6. A tong assembly comprising:

a case assembly including an enclosure defining an interior;

a bearing assembly disposed in the interior of the enclosure, the bearing assembly including a first bearing member defining a first cavity and a second cavity and a second bearing member defining a first cavity and a second cavity; and a tong head assembly disposed in the interior of the case assembly, the tong head assembly including an outer ring gear, the outer ring gear including a first axial end portion, an oppositely disposed second axial end portion and a central portion, the central portion including a plurality of gear teeth, the first axial end portion being disposed in the first cavity of the first bearing member and a first portion of the central portion is disposed in the second cavity of the first bearing member, the second axial end portion being disposed in the first cavity of the second bearing member and a second portion of the central portion being disposed in the second cavity of the second bearing member.

7. The tong assembly of claim 6, wherein the tong head assembly has an open head configuration.

8. The tong assembly of claim 6, wherein the first portion of the central portion is equal to about 50% of a width of the central portion.

9. The tong assembly of claim 8, wherein the second portion of the central portion is equal to about 50% of the width of the central portion.

10. The tong assembly of claim 6, wherein the first bearing member is made from a phenolic material.

11. The tong assembly of claim 10, wherein the second bearing member is made from a phenolic material.

12. The tong assembly of claim 6, wherein each of the first and second bearing members defines a channel that extends outwardly in a radial direction from a thru-bore, which extends though first and second axial ends of the first and second bearing members, through an outer periphery of each of the first and second bearing members.

13. The tong assembly of claim 6, wherein the first bearing member defines a first gear access opening that extends through an outer surface of the first bearing member and through an inner surface of the second cavity of the first bearing member, the second bearing member defining a second gear access opening that extends through an outer surface of the second bearing member and through an inner surface of the second cavity of the second bearing member, external teeth of the central portion of the outer ring gear being accessible through the first and second gear access openings.

14. The tong assembly of claim 6, further comprising a brake band assembly engaged to an exterior of the enclosure of the case assembly, the brake band assembly being aligned with a center opening of the outer ring gear, which extends though the first and second end portions, the brake band assembly including an outer band and an inner band engaged to the outer band, an inner diameter of the brake band assembly being adjustable.

15. The tong assembly of claim 14, wherein the inner band of the brake band assembly is removable from the outer band.

16. An outer ring gear assembly for a tong assembly comprising:

an outer ring gear including a first axial end portion, an oppositely disposed second axial end portion and a central portion disposed between the first and second axial end portions, the central portion having an outer diameter that is greater than an outer diameter of the first axial end portion and an outer diameter of the second axial end portion, the central portion including a plurality of external teeth;

a bearing assembly including:

a first bearing member having a first axial end and an oppositely disposed second axial end and defining a thru-bore that extends through the first and second axial ends, the first bearing member defining a first cavity disposed adjacent to the first axial end and a second cavity disposed adjacent to the second axial end, an inner diameter of the second cavity being greater than an inner diameter of the first cavity;

a second bearing member having a first axial end and an oppositely disposed second axial end and defining a thru-bore that extends through the first and second axial ends, the second bearing member defining a first cavity disposed adjacent to the first axial end and a second cavity disposed adjacent to the second axial end, an inner diameter of the second cavity being greater than an inner diameter of the first cavity;

wherein the first axial end portion of the outer ring gear is disposed in the first cavity of the first bearing member and a first portion of the central portion of the outer ring gear is disposed in the second cavity of the first bearing member, the second axial end portion of the outer ring gear being disposed in the first cavity of the second bearing member and a second portion of the central portion of the outer ring gear being disposed in the second cavity of the second bearing member.

17. The outer ring gear assembly of claim 16, wherein the second axial end of the first bearing member abuts the second axial end of the second bearing member.

18. The outer ring gear assembly of claim 17, wherein the first bearing member defines a first gear access opening that extends through an outer surface of the first bearing member and through an inner surface of the second cavity of the first bearing member, wherein the first gear access opening is adapted to provide access to the external teeth of the outer ring gear.

19. The outer ring gear assembly of claim 18, wherein the second bearing member defines a second gear access opening that extends through an outer surface of the second bearing member and through an inner surface of the second cavity of the second bearing member, wherein the first and second gear access openings adapted to provide access to the external teeth of the outer ring gear.

20. The outer ring gear assembly of claim 19, wherein the bearing assembly is made of a phenolic material.

* * * * *